US009783751B2

(12) United States Patent
Hyman

(10) Patent No.: US 9,783,751 B2
(45) Date of Patent: Oct. 10, 2017

(54) PRODUCTION OF LIQUID HYDROCARBONS

(71) Applicant: IGTL TECHNOLOGY LTD, Aberdeenshire (GB)

(72) Inventor: Richard John Hyman, Aberdeen (GB)

(73) Assignee: IGTL TECHNOLOGY LTD, Aberdeenshire (GB)

( * ) Notice: Subject to any disclaimer, the term of this patent is extended or adjusted under 35 U.S.C. 154(b) by 0 days.

(21) Appl. No.: 14/389,817

(22) PCT Filed: Apr. 5, 2013

(86) PCT No.: PCT/GB2013/050898
§ 371 (c)(1),
(2) Date: Oct. 1, 2014

(87) PCT Pub. No.: WO2013/150319
PCT Pub. Date: Oct. 10, 2013

(65) Prior Publication Data

US 2015/0060326 A1 Mar. 5, 2015

(30) Foreign Application Priority Data

Apr. 5, 2012 (GB) ..... 1206196.6

(51) Int. Cl.

| | |
|---|---|
| ***C10G 2/00*** | (2006.01) |
| ***C10L 1/04*** | (2006.01) |
| ***C10G 35/04*** | (2006.01) |
| ***C10G 45/58*** | (2006.01) |
| ***C10L 1/06*** | (2006.01) |
| ***C10L 1/08*** | (2006.01) |

(52) U.S. Cl.
CPC ..... *C10L 1/04* (2013.01); *C10G 2/332* (2013.01); *C10G 2/343* (2013.01); *C10G 35/04* (2013.01); *C10G 45/58* (2013.01); *C10L 1/06* (2013.01); *C10L 1/08* (2013.01); *C10G 2300/4081* (2013.01); *C10G 2400/02* (2013.01); *C10G 2400/04* (2013.01); *C10G 2400/08* (2013.01); *C10G 2400/20* (2013.01); *C10L 2200/0438* (2013.01); *C10L 2200/0446* (2013.01); *C10L 2200/0492* (2013.01); *C10L 2270/023* (2013.01); *C10L 2270/026* (2013.01)

(58) Field of Classification Search
CPC ... C10G 2/00; C10G 2/30; C10G 2/33; C10G 2/50
See application file for complete search history.

(56) References Cited

U.S. PATENT DOCUMENTS 4,234,412 A * 11/1980 Boersma ..... B01J 29/88 208/92
4,499,209 A * 2/1985 Hoek ..... B01J 23/75 502/242
4,544,792 A 10/1985 Smith et al.
4,892,643 A * 1/1990 Herbst ..... B01J 8/005 208/120.01
6,068,760 A * 5/2000 Benham ..... C10G 2/342 208/950
6,331,573 B1 12/2001 Kibby
6,369,286 B1 * 4/2002 O'Rear ..... C10G 2/30 585/324
6,455,595 B1 9/2002 O'Rear et al.
6,458,265 B1 * 10/2002 Miller ..... C10L 1/08 208/137
6,627,666 B1 * 9/2003 Pedersen ..... B01J 23/78 518/706
6,822,006 B1 * 11/2004 O'Rear ..... B01J 8/22 518/700
6,897,246 B2 5/2005 Espinoza et al.
7,012,102 B2 3/2006 Font Freide et al.
7,667,086 B2 2/2010 Kowalik et al.
(Continued)

FOREIGN PATENT DOCUMENTS

WO 0174970 A2 10/2001

OTHER PUBLICATIONS

International Search Report for PCT/GB2013/050898 dated May 28, 2013.
Great Britain Search Report for Application No. GB1206169.6 dated Aug. 2, 2012.
Yan et al., "Supercritical-Phase Process for Selective Synthesis of Heavy Hydrocarbons from Syngas on Cobalt Catalysts", Applied Catalysis A: General 171, pp. 247-254 (1998).
Iglesia, "Design, Synthesis, and Mechanistic Evaluation of Iron-Based Catalysis for Synthesis Gas Conversion to Fuels and Chemicals", Technical Progress Report for Department of Chemical Engineering, University of California at Berkeley, Period ending Sep. 30, 2004. (Retrieved from (http://www.osti.gov/scitech/servlets/purl/875336-4INf1M/.).
(Continued)

*Primary Examiner* — Randy Boyer
(74) *Attorney, Agent, or Firm* — Heslin, Rothenberg, Farley & Mesiti, P.C.

(57) ABSTRACT

The invention relates to a process for the conversion of hydrogen and one or more oxides of carbon to hydrocarbons, which process comprises:

contacting hydrogen and one or more oxides of carbon with a catalyst in a reaction zone; removing from the reaction zone an outlet stream comprising unreacted hydrogen, unreacted one or more oxides of carbon and one or more hydrocarbons and feeding the outlet stream to a separation zone in which the outlet stream is divided into at least three fractions, in which;

a first fraction predominantly comprises unreacted hydrogen, unreacted one or more oxides of carbon and hydrocarbons having from 1 to 4 carbon atoms;

a second fraction predominantly comprises hydrocarbons having 5 to 9 carbon atoms, at least a portion of which hydrocarbons having from 5 to 9 carbon atoms are olefinic; and a third fraction predominantly comprises hydrocarbons having 10 or more carbon atoms;

characterized in that at least a portion of the second fraction is recycled to the reaction zone.

19 Claims, 5 Drawing Sheets

(56) References Cited

U.S. PATENT DOCUMENTS

| | | | | |
|---|---|---|---|---|
| 2002/0120018 | A1 | 8/2002 | Moore, Jr. et al. | |
| 2004/0009871 | A1* | 1/2004 | Hu | B01J 23/745 502/338 |
| 2004/0074810 | A1 | 4/2004 | Hoek et al. | |
| 2004/0092609 | A1 | 5/2004 | Espinoza et al. | |
| 2008/0200569 | A1 | 8/2008 | Marion et al. | |

OTHER PUBLICATIONS

Elbashir et al., "An Approach to the Design of Advanced Fischer-Tropsch Reactor for Operation in Near-Critical and Supercritical Phase Media", Proceedings of the 1st Annual Gas Processing Symposium, pp. 1-11 (2009).

Liu et al., "Performance Evaluation Under Supercritical Conditions of Fe—Mn—Cu—K Composite Catalysts Synthesized by Supercritical Methods", Fuel Processing Technology 90, pp. 1480-1485 (2009).

Malek Abbaslou et al., "Review on Fischer-Tropsch Synthesis in Supercritical Media", Fuel Processing Technology 90, pp. 849-856 (2009).

Biquiza et al., "Thermodynamic and Experimental Aspects of 'Supercritical' Fischer-Tropsch Synthesis", Fuel Processing Technology 91, pp. 1250-1255 (2010).

Zhang et al., "Production of Middle Distillate Range Transportation Fuels Via Fischer Tropsch Synthesis with Integrated Upgrading Under Supercritical Phase Conditions", AIChE Annual Meeting, Conference Paper, Oct. 2011 (Abstract Only).

* cited by examiner

PRODUCTION OF LIQUID HYDROCARBONS

CROSS REFERENCE TO RELATED APPLICATIONS

This application is a national stage filing under section 371 of International Application No. PCT/GB2013/050898, filed on Apr. 5, 2013, and published in English on Oct. 10, 2013, as WO 2013/150319. PCT/GB2013/050898 claims priority to Great Britain application 1206196.6, filed on Apr. 5, 2012. The entire disclosures of each of the prior applications are hereby incorporated herein by reference.

FIELD OF THE INVENTION

The present invention relates generally to the conversion of mixtures of hydrogen and one or more oxides of carbon, such as syngas, to hydrocarbons, in particular hydrocarbons that are liquid at room temperature (25° C.) and atmospheric pressure (1 atm, 101325 Pa).

BACKGROUND

The potential shortage of traditional petroleum reserves and the increasing instability of international hydrocarbon markets have prompted a search for processes to convert a range of feedstocks to low, intermediate and high boiling range hydrocarbons, including alkanes and olefins. Such alkanes and olefins can be useful in the production of fuels such as gasoline and middle distillate fuels, as speciality solvents, as chemical intermediates, as components of drilling mud oils and in the production of lubricants. Alkanes having 10 to 20 carbon atoms ($C_{10-20}$ alkanes), for example, are particularly valuable as distillate-range transport fuels, such as diesel and jet fuels. Olefins can be used as precursors for a wide variety of chemical and petrochemical products, such as in the preparation of various derivative end products for the manufacture of chemicals.

The Fischer-Tropsch process can be used to convert syngas (a mixture of carbon monoxide, hydrogen and typically also carbon dioxide) into liquid hydrocarbons. Syngas can be produced through processes such as partial oxidation or steam reforming of hydrocarbons. Feedstocks for syngas production include biomass, natural gas, coal or solid organic or carbon-containing waste or refuse. One way of accessing remote natural gas is to convert it into liquid hydrocarbons (via syngas) and to transport the resulting liquid products. This "on-site" processing of the natural gas into liquid products, often termed Gas To Liquids (GTL), can avoid the need for expensive infrastructure such as long distance pipelines, or cryogenic storage and transport facilities that are needed to distribute it as liquefied natural gas (LNG). As oil reserves are depleted, and as oil prices increase, there is increasing incentive to convert such remote natural gas resources into commodity liquid fuels and chemicals.

Fischer-Tropsch synthesis can be tuned to convert syngas to a selective product distribution of olefinic hydrocarbons also containing paraffins, in varying olefin/paraffin ratios, depending on the catalyst composition, pre-treatment procedures and reaction conditions. Catalysts having various combinations of elements have been tested in the past. Fischer-Tropsch catalysts can contain Group VIII transition metals, typically cobalt, iron or ruthenium in combination with various promoters (U.S. Pat. No. 5,100,856).

The Fischer Tropsch reaction is highly exothermic, requiring rapid heat removal. Since the discovery of Fisher-Tropsch synthesis (FTS) over eighty-five years ago, only three major designs for the reactor bed found their way to commercial scale plants. Originally tubular fixed-bed reactors were utilised, but single pass conversions were generally limited to a maximum of 60% in order to control the heat of reaction. Fluidized bed and slurry reactors were subsequently developed to overcome this limitation.

U.S. Pat. No. 7,012,102 describes a Fischer-Tropsch process, which is preferably a slurry phase process, in which light saturated hydrocarbons are separated from the reaction products and fed to a dehydrogenation reactor to produce some unsaturated hydrocarbons, and recycling at least some of the unsaturated hydrocarbons to the reactor. The presence of olefins in the reactor can help increase the length of hydrocarbon chains that are produced by the reaction.

U.S. Pat. No. 6,331,573 describes an integrated process for producing liquid fuels from syngas via a two-stage Fischer-Tropsch reaction, in which the first stage uses conditions in which chain growth probabilities are low to moderate, and the product includes a relatively high proportion of $C_{2-8}$ olefins and a low quantity of $C_{30+}$ waxes, which product is fed to a second stage where chain growth probabilities are relatively high, and wherein light and heavier olefins compete for chain initiation. Most chains are initiated at the $C_{2-8}$ olefins, and the second stage produces a larger fraction in the $C_{5-12}$ range, and a low quantity of waxes.

U.S. Pat. No. 6,897,246 describes a Fischer-Tropsch hydrocarbon synthesis process, in which a $C_2$-$C_9$ olefin-rich stream is separated from a hydrocarbon product stream produced in the reactor to form a light olefin recycle stream, where the light olefin recycle stream is recycled to the reactor system at a point where the $H_2$:CO molar ratio is low relative to the $H_2$:CO ratio in the rest of the reactor system.

US 2002/0120018 relates to an integrated process for improving hydrocarbon recovery from a natural gas resource, by removing heavier hydrocarbons from natural gas, converting methane to syngas, which is then subjected to hydrocarbon synthesis, preferably Fischer-Tropsch synthesis. The produced hydrocarbons are separated into a $C_{1-4}$ fraction, a fraction generally comprising $C_{5-20}$ hydrocarbons, and a fraction generally comprising $C_{20+}$ hydrocarbons.

US 2004/0074810 relates to the production of hydrocarbons in the kerosene/diesel boiling range from a Fischer-Tropsch process, in which (1) hydrocarbons from the Fischer-Tropsch reactor are hydrocracked/hydroisomerised, (2) separating the hydrocarbons into one or more light fractions boiling below the kerosene/diesel boiling range, one or more fractions boiling in the kerosene/diesel boiling range and a heavy fraction boiling above the kerosene/diesel boiling range, (3) subjecting the major part of the heavy fraction to hydrocracking/hydroisomerisation, (4) separating the product stream from (3) into one or more light fractions boiling below the kerosene/diesel boiling range, one or more fractions boiling in the kerosene/diesel boiling range and a heavy fraction boiling above the kerosene/diesel boiling range and (5) hydrocracking/hydroisomerising the major part of the heavy fraction from (4) in the hydrocracking/isomerising process of (1) or (3).

Challenges to optimize existing commercial reactors or to consider alternative designs for FTS processes still exist, in view of the complex nature of the synthesis process as well as the difficulty to control the thermo physical characteristics of the reaction mixture.

In typical FTS reactions carried out in 2 phase fixed-bed operations, gaseous reactor effluent comprising unreacted synthesis gas and light hydrocarbon gas can be recycled to improve conversion efficiency and partly to quench the exothermic reaction. One limitation of using light hydrocarbon gases as a quench is their relatively low thermal conductivity.

Supercritical fluids (SCFs) can offer certain advantages over traditional solvents for catalytic reactions including the ability to manipulate the reaction environment through simple changes in pressure to enhance solubility of reactants and products, to eliminate interphase transport limitations, and to integrate reaction and separation unit operations. SCF solvents offer attractive physical properties including; low viscosity and high diffusivity resulting in superior mass transfer characteristics; low surface tension enabling easy penetration into the pores of a solid matrix (catalyst) for extraction of non-volatile materials from within the pores; high compressibility near the critical point inducing large changes in density with very small changes in pressure and/or temperature. These unique properties of SCFs have been exploited to provide many opportunities for the design of heterogeneous catalytic reaction systems.

Elbashir et al, in Proceedings of the 1st Annual Gas Processing Symposium, 2009, pages 1-11 ("An Approach to the Design of Advanced Fischer-Tropsch Reactor for Operation in Near-Critical and Supercritical Phase Media") describes a reactor system for a super-critical or near-supercritical phase Fischer-Tropsch process. Certain advantages of a supercritical fluid process include gas-like diffusivities and liquid-like solubility which together combine desirable features of the gas and liquid-phase FTS processes. Huang et al in Fuel Chemistry Division Preprints, 2002, 47(1), pages 150-153, report that a supercritical phase reaction can also reduce production of undesirable products; produce less methane because of better distribution of heat in the reactor; produce more long-chain olefins as a result of the enhanced solubility and diffusivity of these higher hydrocarbons in the SCF; mitigate deactivation of the catalyst through better heat and mass transfer; provide in-situ extraction of heavy hydrocarbons from the catalyst surface and their transport out of the pores thereby extending catalyst lifetimes; enhance pore-transport of the reactants such as hydrogen to the catalyst surface thereby promoting desired reaction pathways; enhance desorption of the primary products preventing secondary reactions that adversely affect product selectivity towards longer chain hydrocarbons.

Yan et al in Applied Catalysis A, 171 (1998), pages 247-254, report that a $Co/SiO_2$-catalysed supercritical-phase Fischer-Tropsch process improves extraction of product from the catalyst bed efficiently, and enhances mass transfer for reactants and products. They also report that the addition of 1-tetradecene as a chain initiator can participate in the chain-growth process, which increases the rate of formation of hydrocarbons larger than $C_{14}$ and decreases the yield of $C_{1-13}$ hydrocarbons, leading to a flatter carbon number distribution of product compared to that obtained without addition of the olefin.

There remains a need for an improved Fischer Tropsch process improving the yields of hydrocarbons having 10 or more carbon atoms, in particular hydrocarbons having in the range of from 10 to 25 carbon atoms or from 10 to 20 carbon atoms.

SUMMARY OF THE INVENTION

According to the present invention, there is provided a process for the conversion of hydrogen and one or more oxides of carbon to hydrocarbons, which process comprises:

contacting hydrogen and one or more oxides of carbon with a catalyst in a reaction zone; removing from the reaction zone an outlet stream comprising unreacted hydrogen, unreacted one or more oxides of carbon and one or more hydrocarbons and feeding the outlet stream to a separation zone in which the outlet stream is divided into at least three fractions, in which;

a first fraction predominantly comprises unreacted hydrogen, unreacted one or more oxides of carbon and hydrocarbons having from 1 to 4 carbon atoms;

a second fraction predominantly comprises hydrocarbons having 5 to 9 carbon atoms, at least a portion of which hydrocarbons having from 5 to 9 carbon atoms are olefinic; and a third fraction predominantly comprises hydrocarbons having 10 or more carbon atoms;

characterised in that at least a portion of the second fraction is recycled to the reaction zone.

DETAILED DESCRIPTION OF THE INVENTION

In the process of the present invention, which is typically and preferably a continuous process, hydrogen and one or more oxides of carbon are converted to hydrocarbons, and in particular hydrocarbons that are liquid at 25° C. and atmospheric pressure. By atmospheric pressure is meant 1 atm or 101325 Pa. This is achieved by contacting the hydrogen and one or more oxides of carbon with a catalyst in a reaction zone. The source of hydrogen and one or more oxides of carbon can be syngas. Syngas can be produced from a variety of sources, for example the reforming of natural gas, coal, biomass or domestic or commercial waste that comprises carbon-containing matter. Syngas typically comprises both carbon monoxide and carbon dioxide, in which carbon monoxide is the more predominant oxide of carbon.

The hydrogen concentration in the reaction zone is preferably maintained at a level that does not cause too much hydrogenation of the olefins present therein. Relatively high hydrogen partial pressures in the reaction zone tend to cause hydrogenation of olefins, which can reduce selectivity towards the longer ($C_{10+}$) hydrocarbons. Under higher pressure conditions, in particular where one or more of the components in the reaction zone are approaching or are in the supercritical phase, it is believed that diffusivity of the one or more oxides of carbon is increased, which reduces the concentration of hydrogen atoms on the catalyst surface, which decreases the probability of hydrogenation of olefins to form non-reactive paraffins. This improves the chances of hydrocarbon chain growth, and also increases selectivity to higher olefins. Typical molar ratios of hydrogen to the one or more oxides of carbon that are fed to the reaction zone are in the range of from 0.5:1 to 4:1, for example from 1:1 to 3:1.

In an embodiment, the hydrogen and one or more oxides of carbon can be supplied from separate sources, for example as separate sources of hydrogen, carbon monoxide and carbon dioxide. In a further embodiment, for example if syngas is used as a source of hydrogen and one or more oxides of carbon, additional and separate sources of hydrogen and one or more oxides of carbon can be additionally fed to the reaction zone in order to control the molar ratios of the respective components therein.

The one or more oxides of carbon can predominantly comprise carbon dioxide or can predominantly comprise carbon monoxide. In one embodiment, carbon dioxide is the only carbon oxide (having, for example, no or at most only minor or trace amounts of carbon monoxide, for example at a $CO_2$/CO molar ratio of 99.5 or more) can be used. In such embodiments, it is believed that the hydrocarbon synthesis proceeds predominantly by the formation of carbon monoxide within the reaction zone by means of a reverse water gas shift reaction. Alternatively, carbon monoxide can be the predominant oxide of carbon, which is typically the case where syngas is used as the source of hydrogen and one or more oxides of carbon.

In a further, preferred embodiment, the ratio of molar concentrations of hydrogen, carbon monoxide and carbon dioxide fed to the reaction zone is maintained in the range according to the equation $0.8<[H_2]/(2[CO]+3[CO_2])<1.2$, more preferably $0.9<[H_2]/(2[CO]+3[CO_2])<1.1$, and most preferably $[H_2]/(2[CO]+3[CO_2])=1$.

The reaction produces an outlet stream comprising hydrocarbons, which include both paraffins and olefins, and unreacted starting materials, i.e. unreacted hydrogen and oxides of carbon. The outlet stream is removed from the reaction zone and fed to a separation zone, in which the outlet stream is separated into at least three fractions. The first fraction comprises predominantly unreacted hydrogen, unreacted oxides of carbon, and also hydrocarbons having from 1 to 4 carbon atoms ($C_{1-4}$ hydrocarbons). The second fraction comprises predominantly hydrocarbons having from 5 to 9 carbon atoms ($C_{5-9}$ hydrocarbons), at least a portion of which are olefins. The third fraction predominantly comprises hydrocarbons having 10 or more carbon atoms ($C_{10+}$ hydrocarbons).

By "predominantly comprises" is meant that the fraction comprises greater than 50% on a molar basis of the combined specified components, preferably at least 60%, such as at least 63%.

The first fraction contains components with relatively low boiling points, and can be separated from the outlet stream in one embodiment by flash separation, in which the outlet stream is fed to a flash separation zone and separated into a gaseous fraction and a liquid fraction. The gaseous fraction is the first fraction, and the liquid fraction predominantly comprises hydrocarbons having more than 4 carbon atoms ($C_{5+}$ hydrocarbons), and which undergo further subsequent separation into the second and third fractions. In this embodiment, there can be more than one flash separation zone in order to increase separation of the low boiling components from the $C_{5+}$ hydrocarbons. The gaseous fractions from any or all of these flash separation zones can be combined with the gaseous fraction from the first flash separation zone to form the first fraction. A further liquid fraction may optionally also be removed from any vessel in the flash separation zone, containing water and oxygen-containing compounds (e.g. alcohols, ethers, aldehydes, ketones, carboxylic acids). Such oxygen-containing compounds often form as by-products of the Fischer-Tropsch process, in addition to water, and can be separated as a liquid phase that is denser/heavier than the hydrocarbon-containing liquid fraction predominantly comprising $C_{5+}$ hydrocarbons.

The liquid fraction predominantly comprising $C_{5+}$ hydrocarbons from the flash separation zone, or combination of such liquid fractions from the more than one flash separation zones, is fed to a fractionation zone. In the fractionation zone, a second fraction is removed comprising predominantly hydrocarbons having from 5 to 9 carbon atoms ($C_{5-9}$ hydrocarbons), and which has a relatively higher boiling point than the first fraction. A third fraction is also removed predominantly comprising hydrocarbons having 10 or more carbon atoms ($C_{10+}$ hydrocarbons), and which has a relatively higher boiling point than the second fraction. In this fractionation zone, any residual low boiling components such as unreacted hydrogen, unreacted oxides of carbon and $C_{1-4}$ hydrocarbons can also be removed and optionally combined with the first fraction. A further liquid fraction may optionally be removed from any vessel in the separation zone, containing water and oxygen-containing compounds, which can separate out as a liquid phase that is denser/heavier than the hydrocarbon-containing liquid fraction predominantly comprising $C_{10+}$ hydrocarbons.

Instead of having a flash separation zone to remove a first fraction and a separate fractionation zone for removing the second and third fractions, there can be a single fractionation zone in which all three of the first, second and third fractions can be separated simultaneously.

The first fraction can be recycled to the reaction zone in order to improve conversion of unreacted hydrogen and oxides of carbon to hydrocarbons. In addition, any olefins present in the $C_{1-4}$ hydrocarbons of the first fraction can help to achieve chain growth of the hydrocarbons in the reaction zone, and help to improve yields of higher length hydrocarbons, such as those in the $C_{5-9}$ and the $C_{10+}$ range.

To prevent too great a build-up of inert $C_{1-4}$ alkanes within the reaction zone, which would reduce reaction rates and conversions, at least a portion of the first fraction should not be recycled, and instead should be purged from the system. The purged components can be disposed of, e.g. as fuel to a power generation facility, or can be used to produce or be combined with liquefied petroleum gas (LPG). In one embodiment, because the purged component contains methane, it can be fed to a reformer for further syngas generation. In another embodiment, it can be used as fuel in a burner for generating heat for a reformer.

In one embodiment, the first fraction is further processed to produce a $C_3$-$C_4$ fraction which comprises an increased concentration of $C_3$-$C_4$ hydrocarbons compared to the first fraction, which $C_3$-$C_4$ fraction is fed to a dehydrogenation unit which is maintained under conditions such that $C_3$-$C_4$ alkanes can be converted to corresponding olefins, to produce a $C_3^=$-$C_4^=$ fraction that has an increased concentration of $C_3$-$C_4$ olefins compared to the $C_3$-$C_4$ fraction. A portion of this fraction can optionally be fed to the reaction zone, or can be used elsewhere, for example as an intermediate in the production of gasoline, or for use in chemicals synthesis.

In addition to the $C_3$-$C_4$ fraction, there is also a lights fraction, comprising CO, $H_2$ and $C_1$ to $C_2$ hydrocarbons at a greater concentration than the first fraction. In one embodiment, at least a portion of this lights fraction is fed to a reformer, in which at least a portion of the $C_1$-$C_2$ hydrocarbons are converted to CO and/or $CO_2$, before being returned to the reaction zone. Such an embodiment is particularly advantageous where the hydrogen concentration in the reaction zone is high, for example if syngas is used that has been produced from a low-carbon carbonaceous feedstock such as natural gas, as it helps to reduce loss of carbon.

The second fraction comprises predominantly $C_{5-9}$ hydrocarbons, at least some of which are olefinic. At least a portion of this fraction is recycled to the reaction zone. The advantage of this is that $C_5$-$C_9$ olefins can act to increase the chain length of the hydrocarbons formed in the reaction zone. Because the chain propagating reactions of $C_{5-9}$ olefins are generally less exothermic than reactions with shorter chain olefins, such as $C_{1-4}$ olefins, heat generated in the reaction zone can be consequently reduced, or at least controlled.

In addition, $C_{5-9}$ hydrocarbons have a greater heat capacity than lighter $C_{1-4}$ hydrocarbons, and hence when recycled to the reaction zone they have a consequently greater heat sink or heat removal effect. This further helps to mitigate the heat generated by the exothermic reactions occurring in the reaction zone, and also helps maintain a low temperature gradient across the catalyst in the reaction zone.

As mentioned in the introduction, operating a Fischer-Tropsch reaction under supercritical conditions or close to supercritical conditions has a number of advantages associated with reducing undesirable products in the reactor (such as $C_{1-4}$ alkanes) through better distribution of heat in the reaction zone; producing more long-chain olefins due to enhanced diffusivity or reactants and products, including higher hydrocarbons, in the supercritical or near-supercritical fluid; reduced catalyst deactivation through improved heat and mass transfer; improved extraction of the produced hydrocarbons from the catalyst surface and pores, which improves catalyst lifetime; enhanced pore-transport of reactants such as hydrogen to the catalyst surface, thereby promoting desired reaction pathways; and enhanced desorption of primary products which reduces secondary reactions that adversely affect product selectivity. In the present invention, such advantages can also be achieved by operating the process at relatively high temperatures and pressures, as discussed further below, but where the reaction zone is not necessarily under a supercritical phase.

In order to prevent the build-up of inert $C_{5-9}$ hydrocarbons in the reaction zone, not all of the second fraction should be recycled to the reaction zone. Any unrecycled portion can be used directly for blending with gasoline or for use as gasoline. It can optionally undergo additional treatment, for example isomerisation and/or alkylation, to produce hydrocarbons that can be blended with or used as gasoline. Alternatively, or additionally, a portion of the olefins from the second fraction can be separated for use elsewhere, for example in chemicals production, or alternatively sent to a power generation facility for use as fuel. In a further embodiment, a portion of the second fraction can be dehydrogenated to increase the concentration of $C_5$-$C_9$ olefins, before being recycled to the reaction zone. Preferably, the molar ratio of $C_{5-9}$ olefins in the $C_{5-9}$ hydrocarbons in the second fraction is maintained above 1:1, and more preferably above 2:1.

The third fraction produced in the separation zone comprises hydrocarbons in the $C_{10+}$ range, which can be used as or used to produce middle distillate fuels such as diesel oil and kerosene, the latter of which can be a constituent of jet fuel or can be used in the production of jet fuel. The hydrocarbons from the third fraction can be isomerised and/or hydrogenated to convert olefins to the corresponding linear and branched alkanes using known processes in the art. Additionally, or alternatively, the olefins can be separated and used in chemicals production, for example in the production of lubricants. Typically, the third fraction predominantly comprises hydrocarbons in the $C_{10}$-$C_{25}$ range. To prevent excessive quantities of larger and/or higher boiling hydrocarbons being present in the third fraction, a further fraction (e.g. a fourth fraction) can be removed from the separation zone comprising predominantly such higher boiling hydrocarbons. Preferably, the third fraction predominantly comprises hydrocarbons having 10 to 25 carbon atoms ($C_{10-25}$ hydrocarbons), more preferably the third fraction predominantly comprises hydrocarbons having 10 to 20 carbon atoms ($C_{10-20}$ hydrocarbons). Any long chain length hydrocarbons that may be separated in a higher boiling fraction (e.g. a fourth fraction) of the separation zone can optionally undergo further processing, such as cracking or hydrocracking, to convert them to shorter chain hydrocarbons, for example in the gasoline, kerosene or diesel oil range.

An advantage of the recycling of at least a portion of the second fraction of the separation zone to the reaction zone is that the $C_{5-9}$ olefins contained therein are less reactive towards hydrocarbon chain propagation than lower chain olefins, i.e. $C_{2-4}$ olefins, which mitigates the heat generated by exothermic reactions within the reaction zone.

A portion of the third fraction can optionally be recycled, which can help further provide control on heat generated in the reaction zone.

Any hydrocarbons in the second and third fractions that are not recycled to the reaction zone can be subjected to processes such as isomerisation, as known in the field of gasoline or diesel production. Thus, for $C_{5-9}$ hydrocarbons, increased branching improves the octane value of the hydrocarbons, which makes them more suitable for use as or for blending with gasoline fuels. This can be achieved by means known in the art, for example by using an isomerisation process. In the case of larger hydrocarbons, such as $C_{10+}$ alkanes, branching reduces the melting point of the hydrocarbons, which improves their suitability for use as or for blending with diesel fuels and jet fuels where improved winter or cold-performance is required. Monomethyl-branched iso-alkanes are preferred, to maintain a balance between effective cold temperature properties, with sufficient cetane value when optimised for diesel production.

The reaction taking place in the reaction zone can be a gas-phase reaction in the presence of a fixed solid catalyst bed. Depending on the partial pressure of the hydrocarbons in the reaction zone, at least some of the components can be in the supercritical phase.

The process can be operated such that the reaction zone is maintained at a temperature in the range of from 150 to 400° C., and the pressure maintained in the range of from 10 to 100 bara (1.0 to 10.0 MPa), for example 10 to 85 bara (1.0 to 8.5 MPa).

Fischer Tropsch gas-phase processes are typically classified into high temperature (HTFT) and low temperature (LTFT) processes. HTFT processes are typically catalysed using an iron-containing catalyst, and operate at temperatures in the range of from 300 to 400° C., and pressures in the range of from 10 to 25 bara (1.0 to 2.5 MPa). LTFT processes are typically catalysed using iron or cobalt-containing catalysts, and can operate at temperatures in the range of from 150-240° C., and pressures of from 10-25 bara (1.0 to 2.5 MPa). LTFT gas-phase processes typically favour the formation of longer chain hydrocarbons. However, the present invention provides flexibility in the processing conditions, and allows the temperature in the reaction zone to be tuned, for example by controlling the recycle rate of the second fraction and/or the first fraction from the separation zone, and/or the introduction of fresh hydrogen and one or more oxides of carbon, which can provide control over the heat transport properties of the composition within the reaction zone.

As already discussed above, an advantage of the present invention is that the reaction zone can be operated under supercritical or near-supercritical conditions, with the consequent aforementioned advantages that are associated with such conditions. Thus, in a preferred embodiment of the present invention the reaction zone is operated such that the temperature is in the range of from 170 to 400° C., and the pressure is in the range of from greater than 25 to 85 bara (greater than 2.5 to 8.5 MPa), for example 30 to 85 bara (3.0 to 8.5 MPa) or 35 to 85 bara (3.5 to 8.5 MPa). The weight ratio of the $C_{5-9}$ hydrocarbons to the hydrogen and one or more oxides of carbon is preferably maintained in the range of from 1 to 90%, and can be varied depending on the extent required to control the temperature in the reaction zone, and/or to control the amount of $C_{10+}$ hydrocarbons, in particular the $C_{10-25}$ hydrocarbons and more preferably the $C_{10-20}$ hydrocarbons produced and separated in the third fraction of the separation zone.

In a still further embodiment, the reaction zone is operated at a temperature of at least 250° C., such as in the range of from 250 to 400° C., and pressures of at least 45 bara (4.5 MPa), for example in the range of from 45 to 85 bara (4.5 to 8.5 MPa). By operating in such higher ranges of temperature, particularly at temperatures in the range of from 300 to 400° C., the tendency of the process to produce hydrocarbons having $C_{21+}$ hydrocarbons is reduced, and hence improved selectivity of the process towards $C_{10-20}$ hydrocarbons can be achieved.

Oxygen-containing compounds can be produced in the hydrocarbon synthesis reaction occurring in the reaction zone. These oxygen-containing compounds, which include alcohols, ethers, aldehydes, ketones, carboxylic acids and water, can be separated from the outlet stream of the reaction zone, for example within the separation zone, for example by decantation of an aqueous phase from a separate hydrocarbon-containing phase. It is possible to reduce the formation of oxygenated organic compounds in the reaction zone by choosing particular catalyst components, for example alumina which can be present as a binder in the catalyst.

The reactants and recycled fractions from the separation zone can be fed separately to the reaction zone. Alternatively, some or all of the reactants and recycled fractions can be pre-mixed before being fed into the reaction zone. For example, the hydrogen and one or more oxides of carbon can be fed premixed and simultaneously in the form of a syngas feedstock obtained from a separate process, for example a partial oxidation, autothermal reforming or steam reforming process. In a further embodiment, the fresh reactant feed can be premixed with the recycled fractions from the separation zone before being fed to the reaction zone.

Catalysts and conditions for performing FTS to produce olefins from syngas are well known in literature and to those skilled in the art.

Preferably, the Fischer-Tropsch catalyst compositions used are iron-containing catalysts selected from catalyst systems including Fe/Cu/K; Fe/Ce/K; Fe/Zn/K; Fe/Mn/K and Fe/Co/K, and including composite catalysts comprising any combination of the above said elements, for example Fe/Ce/Cu/K catalysts. Particularly preferred are iron based catalysts having a high atomic ratio of potassium promoter. Examples of suitable iron-containing catalysts include those described in U.S. Pat. No. 4,544,674; U.S. Pat. No. 5,100,856; U.S. Pat. No. 4,639,431; U.S. Pat. No. 4,544,671; U.S. Pat. No. 5,140,049, PCT/EP2012/070897 and by Xu et al in Chemtech (January 1998) pp. 47-53.

Catalysts comprising cobalt and/or ruthenium can also be used in the present invention.

Co-precipitated iron-based catalysts, including those containing cobalt, can be used. High levels of cobalt in an iron-cobalt alloy are known to produce enhanced selectivity to olefinic products, as described, for example, in Stud. Surf. Sci. Catal. 7, Pt/A, p. 432 (1981).

Examples of co-precipitated iron-cobalt catalysts and/or alloys include those described in U.S. Pat. No. 2,850,515, U.S. Pat. No. 2,686,195, U.S. Pat. No. 2,662,090 and U.S. Pat. No. 2,735,862, and also in AICHE 1981 Summer National Meeting Preprint No. 408, "The Synthesis of Light Hydrocarbons from CO and $H_2$ Mixtures over Selected Metal Catalysts" ACS 173rd Symposium, Fuel Division, New Orleans, March 1977; J. Catalysis 1981, No. 72(1), pp. 37-50; Adv. Chem. Ser. 1981, 194, 573-88; Physics Reports (Section C of Physics Letters) 12 No. 5 (1974) pp. 335-374; GB 2050859A; J. Catalysis 72, 95-110 (1981); Gmelins Handbuch der Anorganische Chemie 8, Auflage (1959), pg. 59; Hydrocarbon Processing, May 1983, pp. 88-96; and Chem. Ing. Tech. 49 (1977) No. 6, pp. 463-468.

Iron-cobalt spinels that contain low levels of cobalt, in an iron/cobalt atomic ratio of 7:1 to 35:1, can be converted to Fischer-Tropsch catalysts upon reduction and carbiding, as described for example in U.S. Pat. No. 4,544,674. These catalysts can exhibit high activity and selectivity for $C_{2-6}$ olefins and low methane production, and are also suitable for the present invention.

Other suitable catalysts include those described in U.S. Pat. No. 4,077,995, U.S. Pat. No. 4,039,302, U.S. Pat. No. 4,151,190, U.S. Pat. No. 4,088,671, U.S. Pat. No. 4,042,614 and U.S. Pat. No. 4,171,320. U.S. Pat. No. 4,077,995 discloses a catalyst that includes a sulfided mixture of CoO, $Al_2O_3$ and ZnO. U.S. Pat. No. 4,039,302 discloses a mixture of the oxides of Co, Al, Zn and Mo. U.S. Pat. No. 4,151,190 discloses a metal oxide or sulfide of Mo, W, Re, Ru, Ni or Pt, plus an alkali or alkaline earth metal, with Mo—K on carbon being preferred.

Supported ruthenium catalysts suitable for hydrocarbon synthesis via Fischer-Tropsch reactions are disclosed, for example, in U.S. Pat. No. 4,042,614 and U.S. Pat. No. 4,171,320. U.S. Pat. No. 4,088,671 discloses minimizing methane production by using a small amount of ruthenium on a cobalt catalyst. Any and all of these catalysts can be used in the present invention.

Catalyst modifiers can be used that help minimize olefin hydrogenation without decreasing CO hydrogenation. Examples of suitable manganese-containing materials that can be used include manganese-containing zeolites, unsupported and alumina-supported manganese oxide catalysts and manganese molybdate. Examples of manganese oxide-containing catalysts and/or supports include MnO, $Al_2O_3$—MnO, $SiO_2$—MnO, MnO-carbon, Group IVB-manganese oxides, Group VB-manganese oxides, Group IA (alkali metal)-manganese oxides, Group IIA (alkaline earth metal)-manganese oxides and rare earth-manganese oxides and mixtures thereof. Suitable manganese-containing catalysts are described, for example, in U.S. Pat. No. 4,206,134 and U.S. Pat. No. 5,162,284 which includes Cu-promoted $Co_2MnO_4$ and Cu-promoted $Co_3O_4$. MnO-supported Ru catalysts are described in U.S. Pat. No. 4,206,134. An iron/manganese/potassium catalyst is described in U.S. Pat. No. 4,624,968. Molybdenum carbide catalysts are also suitable. Catalysts in spinel form that include cobalt and manganese, in particular copper-promoted cobalt-manganese spinels with the formula $Co_{3-x}MnO_4$, where x is from about 0.5 to about 1.2, preferably from about 0.7 to about 1.0, most preferably about 1.0, can be used. In these catalysts, the ratio of cobalt to manganese in the spinel is between about 1.5:1 and about 5:1, and the amount of copper promoter in the composition is typically from about 0.1 to about 5 gram atom percent based on the total gram atoms of cobalt and manganese of the dry composition. Copper-promoted cobalt-manganese catalysts tend to be significantly more active and also better at minimizing olefin hydrogenation than analogs promoted with copper but not containing manganese, or catalysts containing manganese but not promoted with copper. Ruthenium-containing catalysts can be used with manganese oxide, other manganese containing oxides or mixtures of various manganese oxides as a catalyst support. Any and all of these catalysts are suitable for use in the present invention.

In a preferred embodiment of the invention, the catalyst comprises iron. More preferred is an iron-containing catalyst that also comprises one or more promoters selected from a manganese promoter, a potassium promoter, a lanthanide promoter such as a cerium promoter, and a copper promoter. Most preferably, the catalyst is an iron-containing catalyst that comprises a manganese promoter, a potassium promoter, a cerium promoter and a copper promoter.

Preferably the reaction zone is operated under conditions such that any $H_2O$ produced does not condense as a liquid within the reaction zone.

EXPERIMENTAL

There now follow non-limiting examples illustrating the invention, with reference to the drawings in which.

Figure 1:
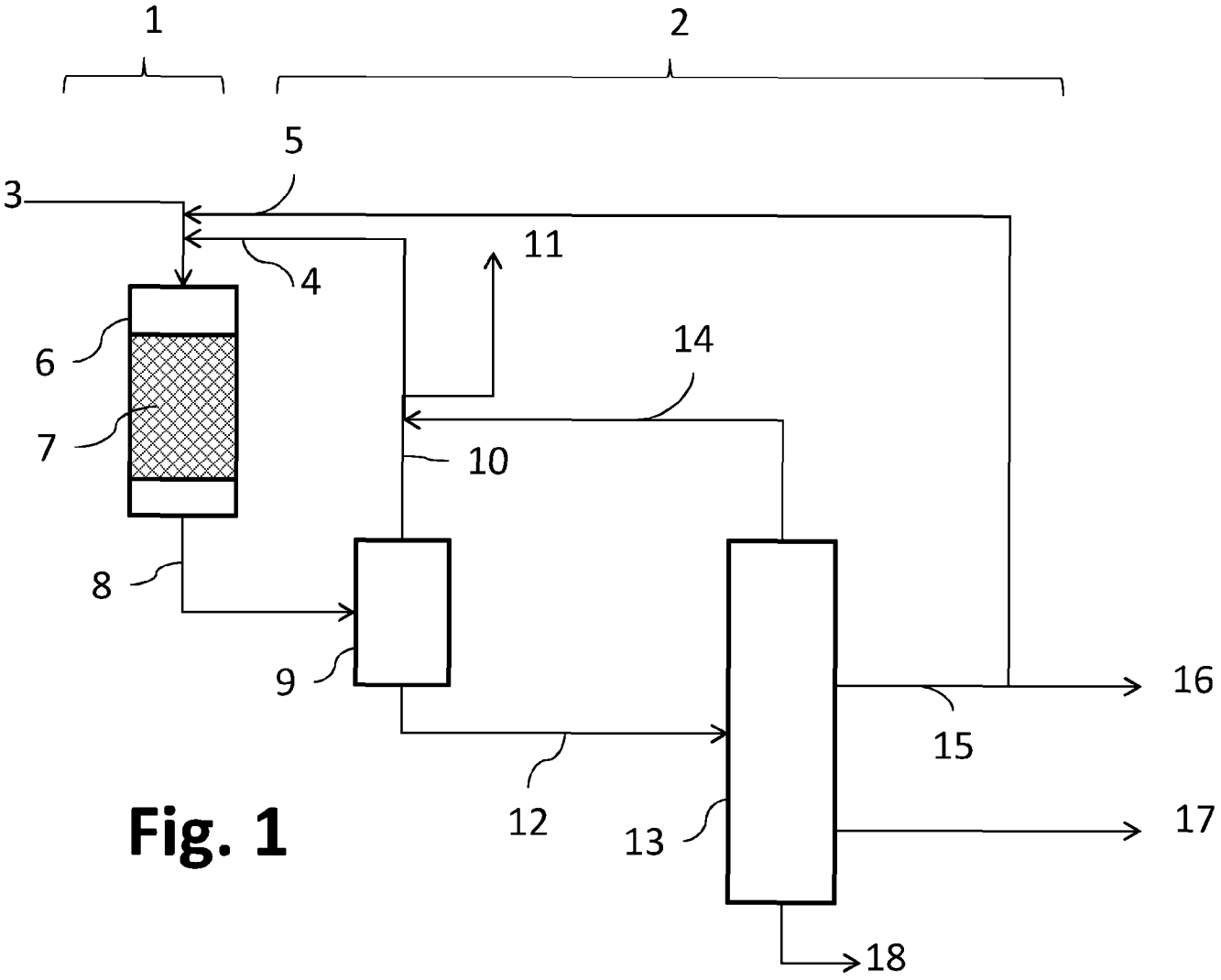
FIG. 1 is a schematic overview of an embodiment according to the present invention.

FIG. 1 shows a process comprising a first section, 1, which relates to the Fischer-Tropsch reactor, associated inlets for feedstocks and recycle lines, and the outlet for the outlet stream, and a second section, 2, which relates to apparatus and process lines associated with separating the outlet stream into various fractions. The first section comprises a syngas inlet, 3, recycle lines from the first, 4, and second, 5, fractions of the separation zone, a reactor, 6 (the reaction zone), containing a fixed, solid particulate catalyst bed, 7, and an outlet for the outlet stream, 8, that leads to the second section. In the embodiment shown, the syngas feedstock is pre-mixed with the recycled components of the first fraction and second fraction from the separation zone before being fed to the reactor.

The second section comprises the separation zone. The separation zone comprises a flash separator as the flash separation zone, 9, in which a gaseous fraction, 10 (the first fraction), comprising predominantly unreacted hydrogen and one or more oxides of carbon together with $C_{1-4}$ hydrocarbons is removed. A portion of this is recycled back to the reactor via recycle line 4, and a portion is removed from the process via purge line 11.

The liquid fraction, 12, from the flash separation zone, predominantly comprising $C_{5+}$ hydrocarbons, is fed to a fractionation column, 13. From the top of the fractionation zone, a light fraction, 14, predominantly comprising further unreacted hydrogen and one or more oxides of carbon together with $C_{1-4}$ hydrocarbons, is removed and combined with the gaseous phase, 10, removed from the flash separation zone. A medium-boiling fraction predominantly comprising $C_{5-9}$ hydrocarbons, 15 (the second fraction), at least some of the hydrocarbons being olefinic, is removed from a lower portion of the fractionation column, a portion of which is recycled to the reaction zone via recycle line 5. An unrecycled portion of the second fraction, 16, is optionally further isomerised to produce branched hydrocarbons in the gasoline boiling range.

A higher boiling fraction, 17, (third fraction) comprising predominantly $C_{10+}$ hydrocarbons, and preferably predominantly $C_{10-20}$ hydrocarbons, is removed from a lower portion of the distillation column. This is also optionally hydrogenated to produce alkanes in the diesel oil boiling range, optionally after additional isomerisation.

A heavy fraction, 18, comprising long chain and high boiling point components is removed from the base of the column, and is optionally converted to diesel oil boiling range alkanes using a process such as hydrocracking, or can optionally be used to make high value synthetic base oils for use as or in the production of lubricants.

Figure 2:
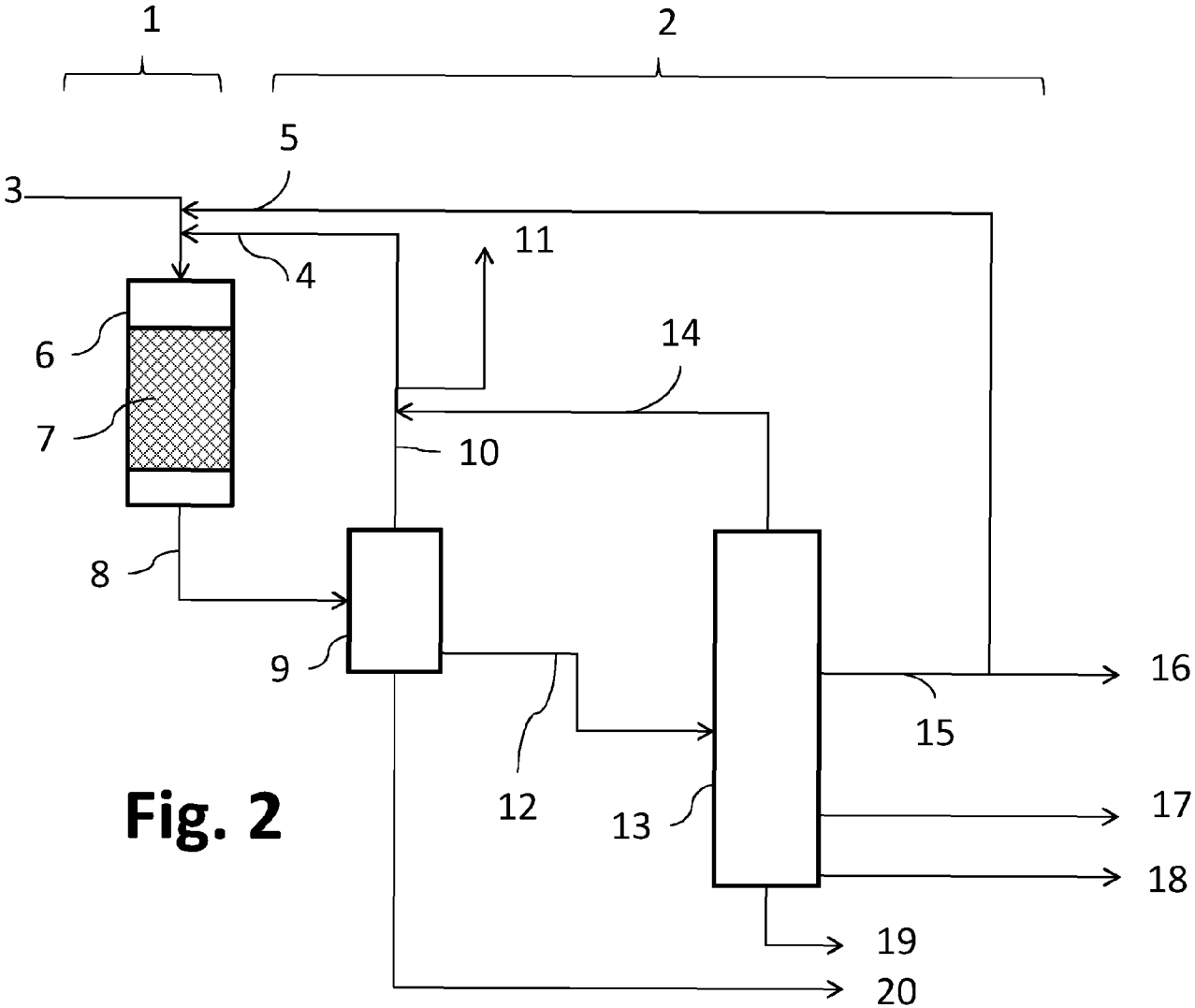
FIG. 2 is a schematic overview of an embodiment similar to FIG. 1, that includes the removal of water and other oxygen-containing compounds in the separation zone.

FIG. 2 shows a similar process to FIG. 1, in which positions for removal of water and other oxygen-containing compounds formed in the reaction are shown. Thus, at the base of each of the two separation zones, 9 and 13, an aqueous phase comprising water and any other dissolved compounds, typically oxygenated organic compounds such as alcohols, and which is separate from the hydrocarbon-containing phases, is removed (respectively 19 and 20). The hydrocarbon-containing phases, 12 and 18, are removed from the columns at a position above the interface with the aqueous phase.

Experiment 1

A zeolite-Y supported iron catalyst was prepared according to a procedure described in PCT application PCT/EP2012/070897 (for catalyst A, pages 30-31). The catalyst contained Fe, Ce, and Cu on a zeolite-Y support, and was prepared as follows:

Y-zeolite was prepared in the $Na^+$ cation exchanged form (NaY), and ion-exchanged with K. The ion exchange of NaY was carried out by adding 12 g of NaY to a 600 ml of a 0.5M $K_2CO_3$ solution in doubly deionized water. The amount of $K_2CO_3$ in the solution represented a 6-fold excess of $K^+$ with respect to the amount of cation-exchanging sites of the zeolite. The resulting suspension was stirred and heated at 80° C. with reflux cooling for a minimum of 4 hours. Subsequently the resulting ion-exchanged zeolite was filtered and washed with doubly deionized water.

This ion-exchange procedure was repeated three times, and the resulting material was dried before use. The resulting KY zeolite was impregnated with a suitable amount of solution of $Fe(NO_3)_2$, $Ce(NO_3)_3$ and $Cu(NO_3)_2$. The volume of solution used was equal to the pore volume of the zeolite added. These nitrate salts are highly soluble and allow the impregnation of metals to be carried out simultaneously. The resulting slurry was dried at 120° C. and calcined in air at 550° C. for 18 h.

The overall composition of the impregnated transition metal ions in the catalyst then reflects the following atomic ratios; Fe:Ce:Cu=86:9.5:4.5. Zeolite-Y with a Si/AI ratio of 2.9 theoretically contains 14.4 wt. % K when fully exchanged.

Figure 3:
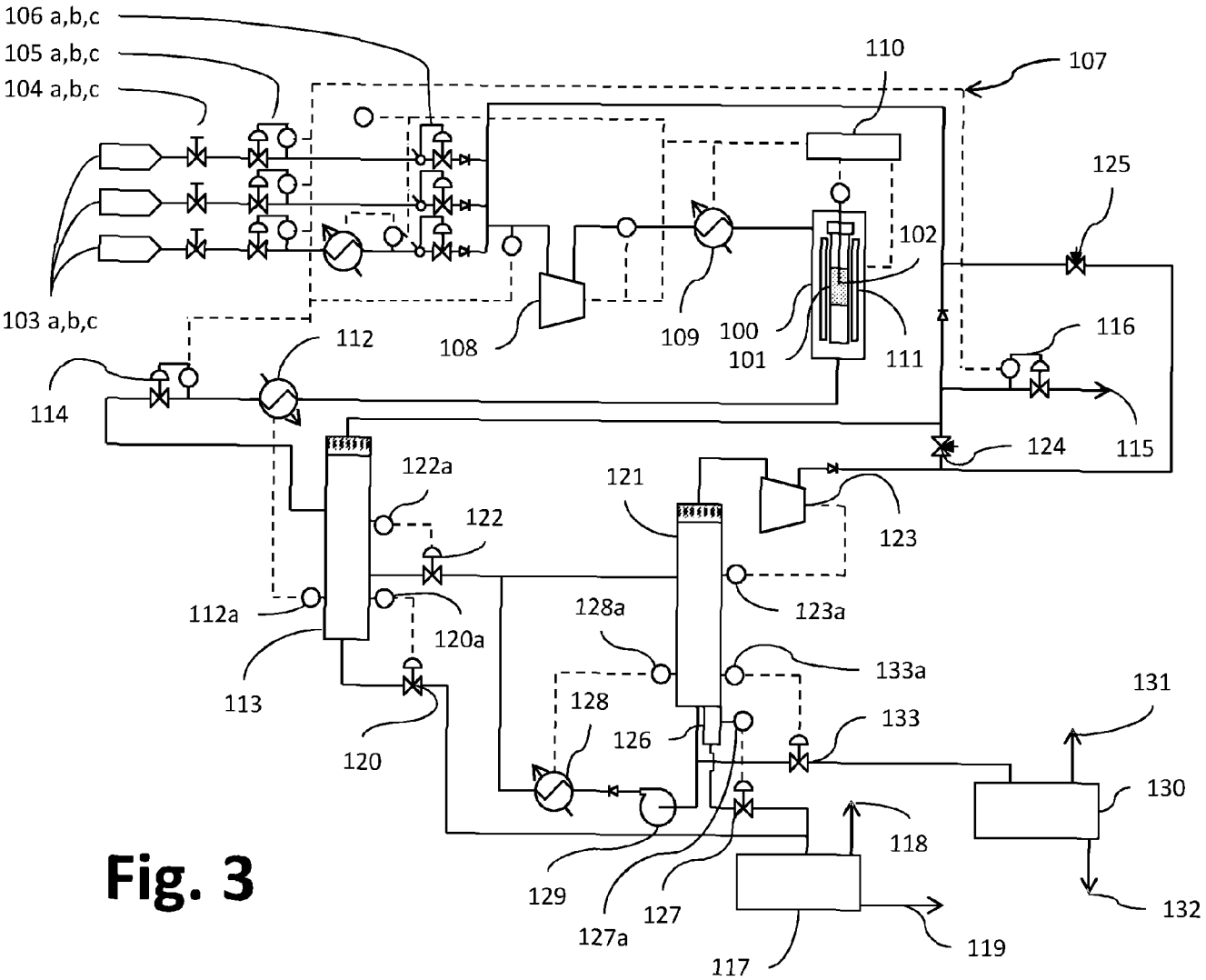
FIG. 3 is a schematic representation of the apparatus used to perform the experiments.

The apparatus shown schematically in FIG. 3 was used to perform single pass and recycle experiments.

10 g of the Fe/Cu/Ce on KY catalyst, with a particle size of 1-2 mm, was loaded into reactor, 100, having internal diameter 22 mm, to form a catalyst bed, 101, with a length of 100 mm. Three thermocouples were located at the top, middle and bottom of the catalyst bed within a thermowell of 6 mm diameter. Only the central thermocouple, 102, is shown in FIG. 3.

The apparatus comprised three gas feed lines, for nitrogen (as a purge), 103*a*, for syngas, 103*b*, and for carbon dioxide, 103*c*. The flows were controlled respectively by isolation valves 104*a*, 104*b* and 104*c*, pressure regulators 105*a*, 105*b* and 105*c*, and mass flow control valves, 106*a*, 106*b* and 106*c*. The pressure regulators and mass flow control valves formed part of the control system, 107, represented generally in FIG. 3 by dashed lines. The syngas feed was a mixture of hydrogen and carbon monoxide, with a $H_2$:CO molar ratio of 2:1.

Compressor, 108, pressurised the gases to the desired reaction pressure. The gases were heated at heater, 109, before passing to the reactor, 100. Temperature controller, 110, interfaced with heat exchanger, 109, was used to maintain a desired temperature in the catalyst bed based on the temperature at thermocouple 102. The reactor comprised a cooling jacket, 111, to avoid large temperature excursions. In the examples described below, reaction pressure was maintained in the range of from 30 to 35 barg.

The hydrocarbon-containing outlet stream from the reactor was cooled via heat exchanger, 112, to near ambient temperature, and then fed to three-phase separator, 113, operating at a pressure of 10 to 15 barg, controlled by pressure regulator, 114. The heat exchanger was regulated based on a temperature measurement, 112*a*, in the separator 113.

The vapour phase from the separator, comprising unreacted syngas components, and light hydrocarbons, typically in the $C_1$ to $C_4$ range, was then removed from the system through vent, 115, or recycled back to reactor, 100 via compressor, 108. The proportion of vented or recycled components was controlled by pressure controller, 116.

A liquid phase comprising water and oxygen-containing compounds was removed from the base of separator 113, and passed via a separation vessel, 117, where vapours were removed via vent, 118, and the remaining water and oxygenate-containing liquid phase being removed from the system via 119. Level control at 120*a* was used to regulate removal of this base stream through valve, 120.

A separate liquid phase stream comprising predominantly $C_{5+}$ hydrocarbons was also removed from the first separator, 113, at a position above the interface with the aqueous phase, and fed to a second separator, 121, regulated by valve 122 based on level control at 122*a*.

A vapour fraction comprising $C_5$ hydrocarbons was removed from the top of the column. Compressor, 123, was used to control the pressure, measured at pressure sensor 123*a*, in the second separator, 121, to less than 6 barg. The temperature of this second column was higher than that of the first column, to increase the proportion of $C_5$ hydrocarbons in the vapour fraction.

This vapour fraction was either recycled to reactor, 100, via compressor, 108. Alternatively, for single pass operation, the fraction was passed to vent, 116, by opening manual control valve, 124, and closing manual control valve 125.

From the base of the second separator, 121, a liquid water and oxygenate-containing phase was removed through a water boot, 126, and passed to vessel 118, as described above for the corresponding liquid phase from the base of the first separator, 113. Flow of the base stream to vessel 117 through valve, 127, was based on level control at 127*a*.

Hydrocarbon liquid phase, comprising the desired product hydrocarbons, was removed from second separator, 121, and split into two streams. One stream formed a recycle loop, which was used to maintain temperature, measured at 128*a*, in second separator, 121. This recycle stream was pumped via pump, 129, through heater, 128, and back to the separator together with hydrocarbon phase from the first separator, 113. The other stream was passed to vessel, 130, where vapours were removed through vent, 131, and product removed through 132. Control of this stream from second separator 121 to vessel 130 was achieved by control of valve 133 based on level measured at 133*a*.

Product removed at 132 was vaporised and analysed by gas chromatography, using a flame induction detector, and using a device fitted with a 25 m, 0.15 mm inner diameter CP-Sil 5 non-polar column.

In the Examples below, the catalyst was pre-reduced in a flow of pure hydrogen at a gas hourly space velocity of 2000, a pressure of 20 barg, and a temperature of 500° C. for 2.5 hours, and allowed to cool to a temperature of 340-350° C. for 30 minutes before being contacted with syngas and brought up to the reaction pressure of 30-35 barg. The syngas flow was started at 180 minutes.

Comparative Example 1

This example used a single-pass configuration, such that there was no recycle of vapour fractions from the first or second separators to the reactor.

From a time period of 180 minutes to 208 minutes on stream, the flow of fresh syngas feed ($H_2$:CO mole ratio of 2:1) was maintained at 200 ml/g catalyst/min (volume based on STP), i.e. a total volume of 2000 ml/min.

Figure 4:
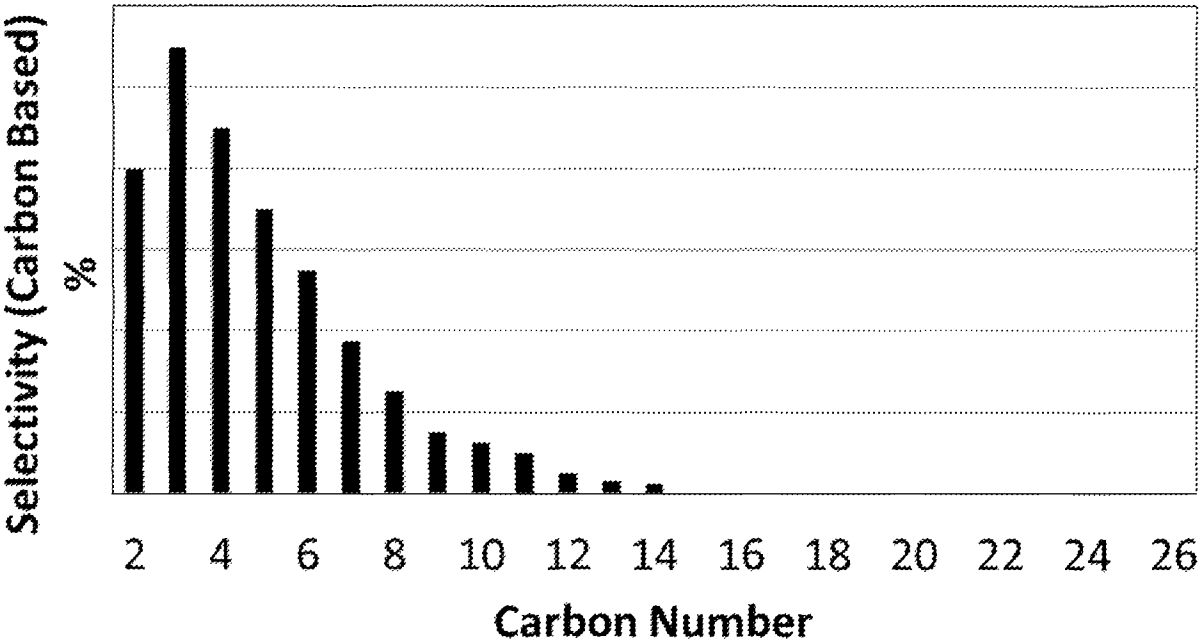
FIG. 4 is a graph showing the hydrocarbon distribution (based on numbers of carbon atoms) in the products of a reaction involving no recycle of hydrocarbons.

The hydrocarbon distribution in the product from 132 collected over the course of this period on stream, based on the numbers of carbon atoms in the hydrocarbon molecules, is shown in FIG. 4. This shows that shorter chain hydrocarbons, predominantly $C_2$-$C_6$ hydrocarbons are the major components of the product.

Example 1

At 208 minutes on-stream, the apparatus was switched to recycle mode, such that a recycle stream comprising vapour fraction from the first and second separation zone was co-fed to the reactor in addition to fresh syngas. Table 1 shows the different volume ratios of the recycled gases to fresh syngas feed at various stages of reaction (measurements taken at the specified time on stream), together with the temperature readings at the top, middle and bottom of the catalyst bed.

TABLE 1

Effects of Recycle Stream on Catalyst Bed Temperature Profile

| Time on stream (min) | Recycle Ratio | Temperature (° C.) Bottom | Middle | Top | Temperature Gradient (° C.) |
|---|---|---|---|---|---|
| 208 | 0 | 357.0 | 321.7 | 291.8 | 65.2 |
| 260 | 2:1 | 359.7 | 337.0 | 312.7 | 40.0 |
| 304 | 4:1 | 355.8 | 340.9 | 322.2 | 33.6 |
| 372 | 8:1 | 337.1 | 335.0 | 330.6 | 6.5 |

For the period 180-208 minutes on stream, fresh syngas only was used (there was no recycle), and a temperature gradient of 65.2° C. was observed across the catalyst bed. The gradient arises as a result of the exothermic reaction associated with the conversion of syngas to hydrocarbons.

Between 208 and 260 minutes on stream, a ratio of recycled gas to fresh syngas of 2:1 was employed. At 260 minutes, just before changing the recycle ratio, a temperature gradient across the catalyst bed of 40° C. was observed, lower than the gradient without any recycle. At 260 minutes, the recycle ratio was changed to 4:1, and at 304 minutes, just before a further change in recycle ratio, the temperature gradient was 34.6° C. Between 304 and 372 minutes on-stream, a recycle ratio of 8:1 was employed, and the temperature gradient at 372 minutes was 6.5° C.

Thus, increases in the proportion of recycled gas compared to fresh syngas feed resulted in lower temperature gradients across the catalyst bed, demonstrating the efficacy of medium sized hydrocarbons in the recycled stream in achieving temperature control in the catalyst, and enabling control of reaction temperature by control of recycle ratio. With reference to FIG. 3, then temperature control in the reactor can be achieved through a variety of mechanisms, for example variation of recycle flow (by control of valves 116, 124 and 125), syngas feed flow (via pressure and mass flow controllers 105*b* and 106*b*), heater control (at heater 109), reactor cooling (at 111) and reactor pressure (via compressor 108).

Figure 5:
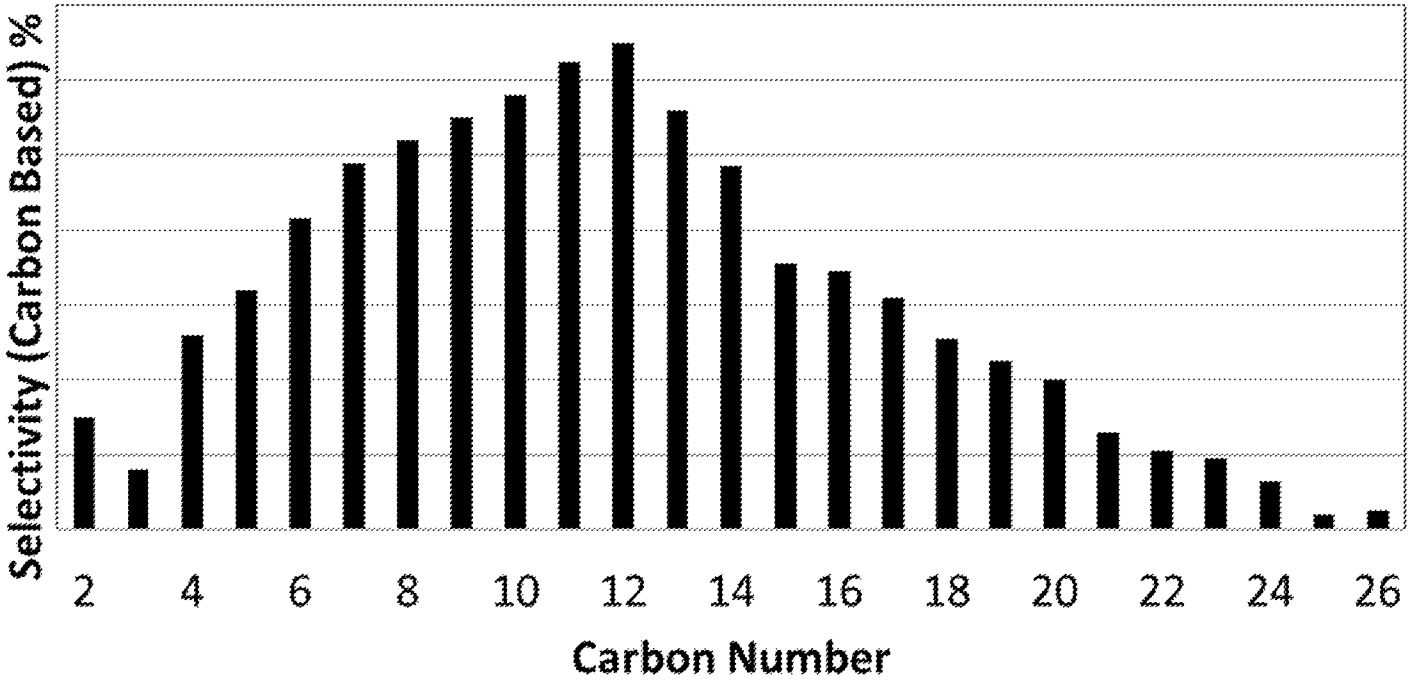
FIG. 5 is a graph showing the hydrocarbon distribution (based on numbers of carbon atoms) in the products of a reaction involving recycle of hydrocarbons.

FIG. 5 shows the hydrocarbon distribution resulting from the combined liquid hydrocarbon product collected at point 132 in FIG. 3 over the whole period of reaction where recycle was employed, i.e. in the period from 208 to 372 minutes on stream. A clear shift to longer hydrocarbon chain lengths is observed demonstrating that not only is improved temperature/exotherm control possible, but also improved product selectivity to higher (C10+) hydrocarbons can be achieved.

The invention claimed is:

1. A process for the conversion of hydrogen and one or more oxides of carbon to hydrocarbons, which process comprises:

contacting hydrogen and one or more oxides of carbon with a catalyst in a reaction zone; removing from the reaction zone an outlet stream comprising unreacted hydrogen, unreacted one or more oxides of carbon and one or more hydrocarbons and feeding the outlet stream to a separation zone in which the outlet stream is divided into at least three fractions, in which;

a first fraction predominantly comprises unreacted hydrogen, unreacted one or more oxides of carbon and hydrocarbons having from 1 to 4 carbon atoms; in which a portion of the first fraction is separated into $C_3$-$C_4$ fraction which comprises an increased concentration of $C_3$-$C_4$ hydrocarbons compared to the first fraction, and a lights fraction, which comprises an increased concentration of hydrogen, one or more oxides of carbon and $C_1$-$C_2$ hydrocarbons compared to the first fraction;

a second fraction predominantly comprises hydrocarbons having 5 to 9 carbon atoms, at least a portion of which hydrocarbons having from 5 to 9 carbon atoms are olefinic; and a third fraction predominantly comprises hydrocarbons having 10 or more carbon atoms;

characterised in that at least a portion of the second fraction is recycled to the reaction zone.

2. A process as claimed in claim 1, in which the reaction zone is maintained at a temperature in the range of from 150 to 400° C. and a pressure in the range of from 10 to 100 bara (1.0 to 10.0 MPa).

3. A process as claimed in claim 1, in which the reaction zone comprises a solid, fixed bed Fischer-Tropsch catalyst.

4. A process as claimed in claim 1, in which the catalyst comprises iron.

5. A process as claimed in claim 4, in which the catalyst comprises one or more promoters selected from a manganese promoter, a potassium promoter, a lanthanide promoter, and a copper promoter.

6. A process as claimed in claim 5, in which the catalyst comprises a manganese promoter, a potassium promoter, a cerium promoter and a copper promoter.

7. A process as claimed in claim 1, in which the separation zone comprises a flash separation zone and a fractionation zone, in which the outlet stream from the reaction zone is fed to the flash separation zone to produce a gaseous fraction which is the first fraction, and a liquid fraction predominantly comprising hydrocarbons having 5 or more carbon atoms, which liquid fraction is fed to the fractionation zone to produce the second fraction predominantly comprising hydrocarbons having 5 to 9 carbon atoms at least a portion of which are olefinic, and a third fraction comprising hydrocarbons having 10 or more carbon atoms.

8. A process as claimed in claim 1, in which at least a portion, but not all, of the first fraction is recycled to the reaction zone.

9. A process as claimed in claim 1, in which at least a portion of the $C_3$-$C_4$ fraction is fed to a dehydrogenation zone which is maintained under conditions such that $C_3$-$C_4$ alkanes can be converted to corresponding olefins, to produce a $C_3^=$-$C4^=$ fraction that has an increased concentration of $C_3$-$C_4$ olefins compared to the $C_3$-$C_4$ fraction, at least a portion of which $C_3^=$-$C_4^=$ fraction is fed to the reaction zone.

10. A process as claimed in claim 1, in which at least a portion of the lights fraction is fed to a reforming zone, in which at least a portion of the $C_1$-$C_2$ hydrocarbons and $CO_2$ are converted to CO and $H_2$ to produce a reformed fraction, at least a portion of which reformed fraction is fed to the reaction zone.

11. A process as claimed in claim 1, in which at least a portion of the unrecycled second fraction is used to make gasoline, or is used to produce hydrocarbons that are blended with gasoline.

12. A process as claimed in claim 11, in which the portion of the unrecycled second fraction is isomerised and/or alkylated before being used as or blended with gasoline.

13. A process as claimed in claim 1, in which at least a portion of the third fraction is used to make jet fuel and/or diesel fuel, or is used to produce hydrocarbons that can be blended with jet fuel and/or diesel fuel.

14. A process as claimed in claim 13, in which the portion of the third fraction is hydrogenated before being used as or blended with jet fuel and/or diesel fuel.

15. A process as claimed in claim 14, in which the portion of the third fraction is isomerised either prior to or during hydrogenation.

16. A process as claimed in claim 2, in which the reaction zone is maintained at a temperature in the range of from 150 to 400° C. and a pressure in the range of from 10 to 85 bara (1.0 to 8.5 MPa).

17. A process as claimed in claim 16, in which the reaction zone is maintained at a temperature in the range of from 170 to 400° C. and a pressure in the range of from 35 to 85 bara (3.5 to 8.5 MPa).

18. A process as claimed in claim 17, in which the reaction zone is maintained at a temperature in the range of from 250 to 400° C. and a pressure in the range of from 45 to 85 bara (4.5 to 8.5 MPa).

19. A process as claimed in claim 5, in which the lanthanide promoter is a cerium promoter.

* * * * *